United States Patent [19]

Gladrow et al.

[11] 3,954,600

[45] May 4, 1976

[54] CATALYTIC CRACKING PROCESS FOR PRODUCING MIDDLE DISTILLATE

[75] Inventors: Elroy M. Gladrow; Daniel F. Ryan, both of Baton Rouge, La.

[73] Assignee: Exxon Research & Engineering Co., Linden, N.J.

[22] Filed: Feb. 15, 1974

[21] Appl. No.: 442,738

[52] U.S. Cl. ..... 208/119; 208/55; 208/71; 208/72; 208/77; 208/113; 208/120

[51] Int. Cl.[2] ..... C10G 37/06; B01J 8/24

[58] Field of Search ..... 208/120, 111, 119, 55, 208/72, 71, 77

[56] References Cited

UNITED STATES PATENTS

| | | | |
|---|---|---|---|
| 2,464,810 | 3/1949 | Hirsch et al. | 208/113 |
| 2,893,943 | 7/1959 | Vignovich | 208/78 |
| 2,927,072 | 3/1960 | Gladrow et al. | 208/46 |
| 3,340,178 | 9/1967 | Hornaday et al. | 208/89 |
| 3,692,667 | 9/1972 | McKinney et al. | 208/120 |
| 3,743,593 | 7/1973 | Saxton | 208/55 |
| 3,758,400 | 7/1973 | Hampton | 208/72 |
| 3,761,391 | 9/1973 | Conner | 208/76 |
| 3,784,463 | 1/1974 | Reynolds et al. | 208/74 |
| 3,821,103 | 6/1974 | Owen et al. | 208/72 |
| 3,847,793 | 11/1974 | Schwartz et al. | 208/70 |

*Primary Examiner*—Delbert E. Gantz
*Assistant Examiner*—G. E. Schmitkons
*Attorney, Agent, or Firm*—M. L. Gibbons

[57] ABSTRACT

A catalytic cracking of hydrocarbons in the presence of an added olefin-containing naphtha increases the selectivity and yield of middle distillate.

9 Claims, 1 Drawing Figure

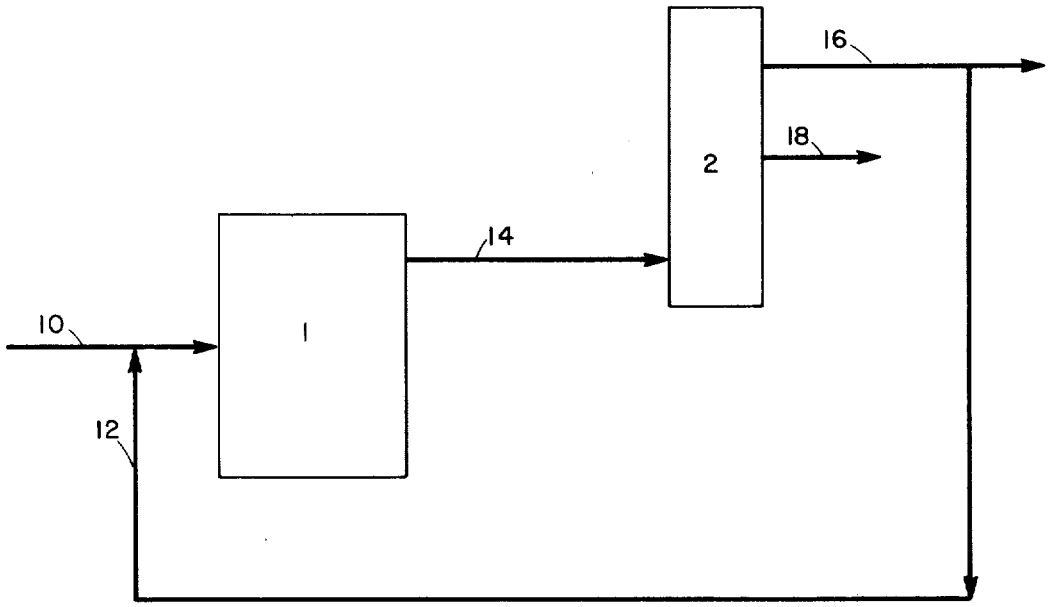
16
18
2
14
10
1
12

CATALYTIC CRACKING PROCESS FOR PRODUCING MIDDLE DISTILLATE

BACKGROUND OF THE INVENTION

1. Field of the Invention

This invention relates to a process for catalytically cracking hydrocarbons to lower boiling hydrocarbon products. It relates particularly to a catalytic cracking process for the production of a maximum amount of hydrocarbon components boiling in the middle distillate range, which are useful, for example, as heating oil.

2. Description of the Prior Art

It is known to optimize the production of gasoline fractions by recycling pyrolitic olefin-containing naphtha to a catalytic cracking zone. Such processes are disclosed, for example, in U.S. Pat. Nos. 3,692,667 and 3,706,654 which teach that a recycle naphtha is subjected to conversion prior to adding the resulting cracked product to the principal conventional catalytic cracking hydrocarbon charge to be cracked.

U.S. Pat. No. 3,758,400 teaches that the addition of small amounts of a debutanized aromatic concentrate containing olefinic and diolefinic hydrocarbons to a conventional catalytic cracking feedstock containing a recycle gas oil results in the formation of increased yield of gasoline of improved octane number when processed over a cracking catalyst.

U.S. Pat. No. 2,608,524 teaches that a superior motor fuel can be produced by cracking a mixture of a straight run naphthenic naphtha and a gas oil in the presence of a bauxite catalyst.

It is also known that hydrocarbons can be catalytically cracked in the presence of added normally gaseous olefins to yield an effluent rich in unsaturated hydrocarbons of the motor fuel boiling range, as disclosed in U.S. Pat. No. 2,626,233.

U.S. Pat. No. 2,464,810 teaches that heavy crude oils or tar can be catalytically cracked to produce a motor fuel by dissolving the heavy oil or tar in a naphtha solvent and subsequently subjecting the solution to a cracking reaction. Part of the naphtha fraction recovered from the catalytic cracking reaction product can be used as naphtha solvent for the heavy feed.

It has now been found unexpectedly that an increased yield and selectivity to middle distillate boiling range components can be produced by catalytically cracking a conventional catalytic cracking hydrocarbon feedstock, such as a gas oil, in the presence of an additional normally liquid olefin-containing naphtha. The term "naphtha" is used herein to refer to a mixture of hydrocarbons boiling (at atmospheric pressure) in the range of about $C_5$ to 430°F. The term "normally liquid olefins" is used herein to refer to olefins boiling (at atmospheric pressure) in the same range as that of the naphtha.

SUMMARY OF THE INVENTION

In accordance with the invention, there is provided a catalytic cracking process in which a hydrocarbon oil is contacted with a cracking catalyst in the presence of an additional normally liquid olefin-containing naphtha, under cracking conditions, to produce lower boiling hydrocarbon products, including an increased amount of hydrocarbon components boiling in the middle distillate range.

In one embodiment of the invention, at least a portion of the naphtha resulting from the catalytic cracking process is recycled to the catalytic reaction zone to provide the required olefin-containing naphtha therein.

BRIEF DESCRIPTION OF THE DRAWING

The FIGURE is a diagrammatic flow plan of one embodiment of the invention.

PREFERRED EMBODIMENT OF THE INVENTION

The preferred embodiment of the invention will be described with reference to the accompanying FIGURE.

Referring to the FIGURE, a hydrocarbon oil feed is introduced into a catalytic cracking zone 1 by line 10. The hydrocarbon oil is a conventional catalytic cracking feedstock, such as a gas oil. By the term "gas oil" is intended herein a mixture of hydrocarbons boiling (at atmospheric pressure) in the range of about 430° to 1100°F. Because it is desired to maximize the yield of middle distillate, it is preferred to utilize a gas oil boiling in the range of about 600° to 1050°F. in the process of the present invention since there is no need to convert the gas oil components boiling below 600°F. The latter can be utilized directly in the middle distillate pool.

A stream of normally liquid olefin-containing naphtha is introduced via line 12 into line 10 which carries the hydrocarbon oil feed into the catalytic cracking zone. Alternatively, the olefin-containing naphtha feed could be introduced separately into the catalytic cracking zone. Suitable normally liquid olefin-containing naphtha is a mixture of hydrocarbons boiling (at atmospheric pressure) in the range of about $C_5$ to 430°F. which contains at least about 10 volume percent olefins boiling within the naphtha range. Preferably, the normally liquid olefin-containing naphtha is a fraction boiling (at atmospheric pressure) in the range of about 100°F. to about 300°F.; more preferably, the normally liquid olefin-containing naphtha is a fraction that contains less than about 30 volume percent aromatics.

Suitable olefin-containing naphthas include, for example, naphtha produced by a catalytic cracking process (cracked naphtha); naphtha produced by a coking process (coker naphtha); naphtha produced by a steam cracking process (steam cracked naphtha).

The volumetric ratio of naphtha to gas oil in the mixture introduced into the catalytic cracking zone may range broadly from 15:85 to 50:50; preferably from 20:80 to 40:60.

The hydrocarbon oil feed and olefin-containing naphtha introduced into catalytic cracking zone 1 contact a conventional cracking catalyst and are simultaneously subjected to catalytic cracking conditions. It should be noted that the olefin-containing naphtha, which may be a cracked naphtha, is not subjected to a further preliminary cracking process to convert any portion thereof prior to being treated with the gas oil in the catalytic cracking zone nor is it contacted with regenerated catalyst at a temperature substantially above the temperature in the main reaction zone. The catalyst present in the catalytic cracking zone may be any conventional cracking catalyst, such as, for example, amorphous silica-alumina; silica-magnesia; silica-zirconia; conventional clay cracking catalysts, etc. The amorphous silica-metal oxide cracking catalyst may further be composited with kaolin in amounts of about 10 to 40 wt. % (based on total weight of the composited catalyst) and up to 10 wt. % crystalline aluminosilicate zeolite, such as, faujasite. These catalysts are well known and commercially available. Preferably, the catalyst utilized in the present invention is an amorphous silica-magnesia catalyst containing from about 15 to 40 weight percent magnesia (relative to the silica), preferably from 25 to 35 weight percent magnesia. As stated above, about 10 to 40 weight percent kaolin may be added. Preparations of typical conventional silica-magnesia catalysts are described, for example, in U.S. Pat. Nos. 3,395,103 and 3,404,097.

Catalytic cracking zone 1 is operated at conventional cracking conditions well known in the art. Fixed, moving or fluidized bed operations may be employed. Suitable operating conditions for the catalytic cracking zone of the present invention include a temperature in the range of 800° to 1000°F., preferably in the range of 850° to 920°F.; a pressure in the range of about atmospheric to 40 pounds per square inch (psig), preferably in the range of atmospheric to 20 psig; a feed rate of about 5 to 20 volumes of feed per volume of catalyst per hour. The actual feed rate employed will depend on the refractoriness of the feed and the desired conversion level.

Under the above given operating conditions, the gas oil feed is converted to lower boiling hydrocarbon products. The catalytic cracking zone effluent is passed via line 14 to a separation zone 2. Separation of the cracked products is carried out in any conventional suitable manner, such as, for example, by fractional distillation. A naphtha fraction (containing olefins) is recovered via line 16 from the separation zone. Preferably, the naphtha fraction is separated as a fraction having an end boiling point of about 300°F. at atmospheric pressure. In the preferred embodiment shown in the FIGURE, at least a portion of the naphtha product (which is an olefinic naphtha) is recycled via line 12 for introduction into the catalytic cracking zone as the additional olefin-containing naphtha. A middle distillate fraction is recovered from separation zone 2 via line 18. By the term "middle distillate" is intended herein a mixture of hydrocarbon constituents boiling, at atmospheric pressure, in the range varying from an initial boiling point about 300°F. to 430°F. to a final point up to about 700°F. Middle distillate is usefuly, for example, as heating oil.

The following examples are presented to illustrate specific embodiments of the invention.

EXAMPLE 1

This example demonstrates that the addition of olefins boiling in the naphtha range to a gas oil feed improves the yields of middle distillate components.

In a set of experiments, a catalyst, to be designated hereinafter as catalyst A, was employed in a captive fluidized bed cracking operation at 900°F. using a 2-minute cracking period. Catalyst A is a commercially available catalyst comprising about 25 to 30 weight percent kaolin composited with about 70 to 75 weight percent silica-magnesia. The silica-magnesia component contained about 30 weight percent MgO and 70 weight percent $SiO_2$. Prior to use, catalyst A was subjected to one atmosphere steam at 1400°F. for 16 hours. The feed was a Safaniya heavy virgin gas oil (V.G.O) alone and a blend of Safaniya heavy gas oil with either octene-1 or with methylcyclohexene (100 volumes gas oil to 44 volumes olefin). The Safaniya heavy virgin gas oil had a boiling point range of 630° to 900°F., a gravity of 23.2°API, and comprised 2.6 weight percent sulfur. The results of these experiments are given in Table I.

TABLE I

| Feed | V.G.O. | V.G.O. + octene−1 | V.G.O. + MCH⁼ |
|---|---|---|---|
| wt. % V.G.O. in total feed | 100.00 | 74.4 | 72.3 |
| Yield (based on V.G.O.) | | | |
| Wt. % Conv. to 600°F⁻ | 52.3 | 51.9 | 50.9 |
| Wt. % $C_3$/300°F. [1] | 18.2 | 12.1 | 24.2 |
| Wt. % 300/600°F. | 28.8 | 33.6 | 33.3 |

[1]The values shown are based on gas oil only. The light olefins have been assumed to be unconverted.

The data given in Table I show that at essentially the same gas oil conversion level, with the added light olefins present in the feed, the yield of 300° to 600°F. middle distillate is increased about 16%. With octene-1 in the feed, there is a lower naphtha yield. The higher naphtha yield when methylcyclohexene (MCH⁼) is present in the feed is believed to be due to a large proportion of its being converted to toluene and other aromatics.

EXAMPLE 2

In another set of experiments, catalyst A (the same catalyst A as the one described in Example 1) and catalyst B were utilized. Catalyst B is a commercially available amorphous gel catalyst comprising about 13 weight percent $Al_2O_3$ and 87 weight percent $SiO_2$. Each of the catalysts (A and B, respectively) was subjected to one atmosphere steam at 1400°F. for 16 hours prior to use in tests with a blended feed comprising 100 volumes of Safaniya heavy virgin gas oil (V.G.O.) and 44 volumes of light catalytic cracked naphtha (LCN). The latter had a boiling range of 185° to 300°F. (at atmospheric pressure); a gravity of 54.0°API, and a hydrocarbon composition of 18.0 weight percent aromatics (i.e. 17.4 volume percent aromatics), 42.7 weight percent olefins (i.e. 42.3 volumes percent olefins), and 39.3 weight percent saturates (paraffins plus naphthenes) (i.e. 40.3 volume percent saturates).

The tests were conducted at 900°F., over a 2-minute process period. The results of the tests are given in Table II.

TABLE II

| Feed | V.G.O. | | V.G.O. + LCN | |
|---|---|---|---|---|
| Wt. % V.G.O. in feed | 100 | | 72.8 | |
| Catalyst | A | | | |
| Feed Rate, W/Hr./W | 7.9 | 11.8 | 9.1[1] | 13.6[1] |
| Conversion, wt.% 600°F.⁻ | 57.6 | 52.3 | 51.7 | 41.0 |
| $C_3$/300°F., wt. % | 20.3 | 18.2 | 5.8 | 0.1 |
| 300/600°F., wt. % | 31.3 | 28.2 | 38.7 | 35.4 |
| Selectivity to mid-distillate, wt. % | 54.4 | 55.0 | 74.9 | 86.3 |
| Mid-distillate/naphtha, wt. ratio | 1.5 | 1.6 | 6.7 | 354.0 |

TABLE II-continued

| Feed | V.G.O. | | V.G.O. + LCN |
|---|---|---|---|
| Catalyst | ——— | B | ——— |
| Feed rate, W/Hr/W | 7.8 | 11.7 | 8.6[1] |
| Conversion, wt. % 600°F⁻ | 48.6 | 41.3 | 50.5 |
| $C_5$/300°F. wt. % | 19.2 | 15.5 | 13.1 |
| 300/600°F., wt.% | 22.4 | 19.9 | 25.3 |
| Selectivity to mid-distillate, wt. % | 46.1 | 48.2 | 50.2 |
| Mid-distillate/naphtha, wt. ratio | 1.2 | 1.3 | 1.9 |

[1]Feed rates and yields are based on Safaniya heavy virgin gas oil only. The light cracked naphtha is assumed to be an unconverted diluent.

The data tabulated in Table II show that with light catalytic cracked naphtha added to the gas oil feed, the yield of middle distillated, the selectivity to middle distillate and the weight ratio of middle distillate (300°–600°F.) to naphtha ($C_5$–300°F.) are unexpectedly improved. These improved results are obtained whether Catalyst A or Catalyst B is used in the tests, provided that light catalytic cracked naphtha is added to the gas oil feed. It should be noted, however, that a greater degree of improvement resulted with the utilization of catalyst A. The data suggest that there is only a small net production of light naphtha with utilization of catalyst A. This would seem to indicate that polymerization and alkylation reactions involving the naphtha (and lighter) components are occurring. Such reactions would result in increased yields of middle distillate and decreased yields of naphtha.

EXAMPLE 3

This example is given to show that the improved middle distillate yields and selectivities shown in Examples 1 and 2 are not caused by the lower gas oil partial pressure due to the presence of the light catalytic cracked naphtha or added light olefins in the feed blend.

In another set of experiments, nitrogen was added along with the gas oil feed at a rate of 44 volumes of nitrogen per 100 volumes (as vapor) of gas oil. The cracking temperature was 900°F. and a 2-minute process period was used. Catalysts A and B utilized in these tests are the same catalysts which have been described in Examples 1 and 2. Prior to use, each the catalysts was subjected to one atmosphere steam for 16 hours.

The results are summarized in Table III.

TABLE III

| Feed | V.G.O. | V.G.O +$N_2$ | V.G.O. | V.G.O.+$N_2$ |
|---|---|---|---|---|
| Catalyst | ——— | A | ——— | |
| Feed rate, W/Hr./W | ——— | 11.6 | ——— | 7.8 |
| Conversion, wt.% 600°F.⁻ | 54.3 | 52.8 | 60.1 | 62.5 |
| 300/600°F. yield, wt.% | 30.6 | 30.4 | 31.7 | 33.2 |
| Selectivity to mid-distillate, wt. % | 56.4 | 57.6 | 52.8 | 53.0 |
| Catalyst | ——— | B | ——— | |
| Feed rate, W/Hr./W | 11.6 | 11.7 | 7.8 | 7.7 |
| Conversion, wt.% 600°F.⁻ | 53.3 | 49.5 | 55.9 | 54.2 |
| 300/600°F. yield, wt.% | 26.0 | 24.1 | 26.4 | 25.0 |
| Selectivity to mid-distillate, wt.% | 48.8 | 48.6 | 47.3 | 46.2 |

As can be seen from the data tabulated in Table III, the addition of the inert nitrogen to the gas oil feed had no significant effect on either catalyst activity or selectivity to middle distillate.

EXAMPLE 4

This example shows that altering the catalyst charge and feed throughput to maintain a constant feed rate of weight parts of feed per hour per one weight part of catalyst (W/Hr./W) does not alter appreciably the conversion or middle distillate levels. The tests were conducted at 900°F. feeding Safaniya heavy virgin gas oil for a 2-minute period, utilizing catalyst A or catalyst B. Catalyst A and B are the same catalysts as previously described. Prior to use, each of the catalysts was subjected to one atmosphere steam at 1400°F for 16 hours.

The results of the tests are summarized in Table IV.

TABLE IV

| | | | | |
|---|---|---|---|---|
| Catalyst | ——— | A | ——— | |
| Catalyst charge, gm | 4 | 8 | 6 | 12 |
| Feed rate, W/Hr./W | —— | 11.7 | —— | 7.8 |
| Conversion, wt.% 600°F.⁻ | 54.7 | 54.3 | 60.1 | 63.5 |
| 300/600°F, wt.% | 30.0 | 30.6 | 31.7 | 32.1 |
| Selectivity to mid-distillate, wt.% | 54.8 | 56.4 | 52.8 | 50.7 |
| Catalyst | ——— | B | ——— | |
| Catalyst charge, gm. | 4 | 8 | 6 | 12 |
| Feed rate, W/Hr./W | 11.7 | 11.6 | —— | 7.8 |
| Conversion, wt.% 600°F.⁻ | 53.9 | 53.3 | 55.9 | 57.8 |
| 300/600°F., wt. % | 25.0 | 26.0 | 26.4 | 24.9 |
| Selectivity to mid-distillate, wt. % | 46.3 | 48.8 | 47.3 | 43.2 |

From the data given in Table IV, it can be seen that changing the catalyst loading and the amount of feed processed did not have a significant effect on the yield and selectivity to middle distillate. The data also showed a greater degree of middle distillate selectivity in the tests utilizing Catalyst A relative to the tests utilizing catalyst B.

EXAMPLE 5

This example shows that catalysts comprising crystalline aluminosilicate zeolites are suitable for use in the process of the present invention.

Catalyst C is a commercially available catalyst comprising about 5 weight percent faujasite dispersed in a matrix which is essentially catalyst A, i.e., it comprises silica-magnesia and about 25 –30 weight percent kaolin. Catalyst D is a commercially available catalyst comprising about 10 weight percent faujasite dispersed in a matrix which is essentially catalyst B, i.e., it comprises silica-alumina. Catalysts A, B, C and D were each employed in a cracking operation feeding Safaniya heavy virgin gas oil at 900°F. Prior to use, catalysts A, B, C and D were each subjected to one atmosphere of steam at 1400°F for 16 hours. The results of the tests are summarized in Table V.

TABLE V

| Catalyst | A | C | B | D |
|---|---|---|---|---|
| Feed rate, W/Hr./W | 11.8 | 11.7 | 1.7 | 11.8 |
| Conversion, wt. % 600°F.⁻ | 52.3 | 63.3 | 41.3 | 56.1 |
| $C_5$/300°F. wt. % | 18.2 | 25.2 | 15.5 | 21.5 |
| 300/600°F., wt. % | 28.8 | 32.3 | 19.9 | 30.8 |
| Selectivity to mid-distillate, wt. % | 55.0 | 51.0 | 48.2 | 55.0 |
| Mid-distillate/naphtha, wt. ratio | 1.6 | 1.3 | 1.3 | 1.4 |

Addition of the zeolite to the matrix increased conversion at the same space velocity. In the test utilizing catalyst C, the selectivity to middle distillate was less than in the test in which catalyst A alone was used (note that the matrix of catalyst C is catalyst A). In the test utilizing catalyst D, there appears to be a small selectivity improvement relative to the test in which catalyst B alone was used (note that the matrix material of catalyst D is catalyst B). It would be expected that the presence of added light catalytic cracked naphtha to the gas oil feed would show improved yields and selectivity to middle distillate when cracked in the presence of catalyst C or catalyst D.

What is claimed is:

1. In a catalytic cracking process wherein a gas oil boiling in the range of about 600° to 1050°F. is converted to lower boiling hydrocarbon products by contacting said gas oil with a cracking catalyst under cracking conditions including a temperature ranging from about 800° to 1000°F. in a conversion zone, the improvement which comprises conducting said contacting step in the presence of an added normally liquid olefin-containing naphtha containing less than about 30 volume percent aromatics, said naphtha containing at least 10 volume percent normally liquid olefins, the volumetric ratio of said naphtha to said gas oil ranging from 20:80 to 40:60, to produce an increased amount of middle distillate components.

2. The process of claim 1 wherein said cracking catalyst is selected from the group consisting of silica-alumina; silica-magnesia and silica-zirconia.

3. The process of claim 2 wherein said catalyst is additionally composited with kaolin.

4. The process of claim 2 wherein said catalyst is additionally composited with a crystalline alumino-silicate zeolite.

5. The process of claim 1 wherein an olefin-containing naphtha is separated from said lower boiling hydrocarbon products and wherein at least a portion of the separated olefin-containing naphtha is recycled to said catalytic cracking zone.

6. The process of claim 1 wherein said olefin-containing naphtha is a naphtha produced by a cracking process.

7. The process of claim 1 wherein said olefin-containing naphtha is a naphtha resulting from a coking process.

8. The process of claim 1 wherein said olefin-containing naphtha is a fraction boiling (at atmospheric pressure) in the range of $C_5$ to about 300°F.

9. A catalytic cracking process which comprises:

a. contacting a gas oil boiling in the range of about 600° to 1050°F. with a silica-magnesia catalyst in the presence of an added normally liquid olefin-containing naphtha fraction boiling in the range of about $C_5$ to 300°F., said naphtha fraction containing at least 10 volume percent normally liquid olefins, and less than 30 volume percent aromatics, the volumetric ratio of said naphtha to said gas oil ranging from 20:80 to 40:60, to produce lower boiling hydrocarbon products;

b. separating said hydrocarbon products into at least a naphtha fraction boiling in the range of about $C_5$ to 300°F., and a middle distillate fraction boiling in the range of about 300° to 600°F., and c. recycling at least a portion of the separated naphtha fraction, without any intervening cracking, to said contacting step (a).

* * * * *